US010272451B2

(12) United States Patent
Ukigai et al.

(10) Patent No.: US 10,272,451 B2
(45) Date of Patent: Apr. 30, 2019

(54) SPOUT APPARATUS

(71) Applicant: TOTO LTD., Kitakyushu-shi, Fukuoka (JP)

(72) Inventors: Kiyotake Ukigai, Kitakyushu (JP); Katsuya Nagata, Kitakyushu (JP); Masateru Miyazaki, Kitakyushu (JP); Yutaka Aihara, Kitakyushu (JP); Shuhei Hayata, Kitakyushu (JP); Kei Watanabe, Kitakyushu (JP); Nao Tanizaki, Kitakyushu (JP); Hiroshi Nishijima, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/377,587

(22) Filed: Dec. 13, 2016

(65) Prior Publication Data

US 2017/0165687 A1 Jun. 15, 2017

(30) Foreign Application Priority Data

Dec. 15, 2015 (JP) ..... 2015-244196

(51) Int. Cl.
*B05B 1/34* (2006.01)
*B05B 1/18* (2006.01)
(Continued)

(52) U.S. Cl.
CPC ..... *B05B 1/34* (2013.01); *B05B 1/08* (2013.01); *B05B 1/185* (2013.01); *B05B 1/22* (2013.01);
(Continued)

(58) Field of Classification Search
CPC ..... B05B 1/34; B05B 1/22; B05B 15/0291; B05B 1/08; B05B 1/185; E03C 1/0408; E03C 1/04
(Continued)

(56) References Cited

U.S. PATENT DOCUMENTS 4,151,955 A * 5/1979 Stouffer ..... B05B 1/08 137/835
6,250,572 B1 6/2001 Chen
(Continued)

FOREIGN PATENT DOCUMENTS

JP 2000-120141 A 4/2000
JP 2004-275985 A 10/2004
(Continued)

*Primary Examiner* — Darren W Gorman
*Assistant Examiner* — Qingzhang Zhou
(74) *Attorney, Agent, or Firm* — Baker & Hostetler LLP

(57) ABSTRACT

To provide a spout apparatus which is easily maintainable by a user even when, in a fluid device utilizing Karman vortices, scale adheres to the Karman vortex generating portion. A spout apparatus for discharging hot or cold water while causing it to reciprocally oscillate, having a spout apparatus body and an oscillating element; whereby the oscillating element has a water supply passage, a vortex generating passage, and a spout port passage; the spout port passage is formed of an elastically deformable soft member and is attached to the spout apparatus body so that a user can manipulate the spout port passage to deform it; and the vortex generating passage is formed of an elastically deformable soft member, and is integrally formed with the spout port passage so that deformations of the spout port passage can be transmitted to this vortex generating passage.

5 Claims, 7 Drawing Sheets

(51) Int. Cl.

| | |
|---|---|
| ***B05B 1/22*** | (2006.01) |
| ***E03C 1/04*** | (2006.01) |
| ***B05B 1/08*** | (2006.01) |
| ***B05B 15/528*** | (2018.01) |
| *E03C 1/02* | (2006.01) |

(52) U.S. Cl.
CPC ..... *B05B 1/341* (2013.01); *B05B 15/528* (2018.02); *E03C 1/0404* (2013.01); *E03C 1/0409* (2013.01); *E03C 2001/026* (2013.01)

(58) Field of Classification Search
USPC .... 239/589.1, 589, 383, 381, 382, 444, 562, 239/525
See application file for complete search history.

(56) References Cited

U.S. PATENT DOCUMENTS

| | | | | |
|---|---|---|---|---|
| 2003/0062426 | A1* | 4/2003 | Gregory | B05B 1/185 239/107 |
| 2010/0072307 | A1* | 3/2010 | Hester | B05B 1/08 239/589.1 |
| 2011/0108640 | A1* | 5/2011 | Grohe | B05B 1/08 239/548 |
| 2011/0233301 | A1* | 9/2011 | Gopalan | B05B 1/08 239/101 |
| 2012/0266376 | A1* | 10/2012 | Marty | B05B 1/185 4/615 |

FOREIGN PATENT DOCUMENTS

| | | | |
|---|---|---|---|
| WO | 79/00236 | A1 | 5/1979 |
| WO | 2012126125 | A1 | 9/2012 |

* cited by examiner without water with water with water

SPOUT APPARATUS

TECHNICAL FIELD

The present invention pertains to a spout apparatus for discharging hot or cold water while causing it to reciprocally oscillate.

BACKGROUND ART

Patent Documents 1-3 below set forth a spout apparatus utilizing an oscillating phenomenon based on a fluid device. In such spout apparatuses, the spout water spray direction can be changed without providing a movable member, thus affording the advantage that a spout apparatus capable of spouting over a wide range can be achieved using a simple and compact constitution.

In the spout apparatus set forth in Patent Document 3 below, as shown in FIG. 13, a fluid which has flowed into an antechamber 110 from an intake hole 114 first collides with an obstacle 116 having a triangular cross section, and disposed as an island within the antechamber 110. When the fluid collides, Karman vortices are alternately formed on the upper and lower sides of the obstacle 116, resulting in a vortex street. This Karman vortex street reaches the outlet 112 as it grows. Close to the outlet 112, the flow velocity on the side where the vortex street is present speeds up, and the flow velocity on the opposite side thereto slows down. In the example shown in FIG. 13, the Karman vortices occur alternately on the upper and lower sides of the obstacle 116; these vortex streets sequentially reach the outlet 112, thereby alternately producing a high flow velocity on the upper side and a high flow velocity on the lower side. In the high flow velocity state on the upper side, the high velocity fluid collides with a wall surface 110*a* on the upper side of the outlet 112 and is changed, while the fluid sprayed from the outlet 112 forms a spray flow which in total is directed diagonally downward. In the high flow velocity state on the lower side, on the other hand, the high flow velocity fluid collides with a wall surface 110*b* on the lower side of the outlet 112, and a spray flow is sprayed diagonally upward from the outlet 112. Alternating repetition of such states results in the spray flow from the outlet 112 being sprayed as it oscillates in a reciprocating manner. Using a spout apparatus of this type, a spout apparatus can be achieved which is capable of spraying over a broad range while being extremely simple and compact.

PRIOR ART DOCUMENTS

Patent Documents

Patent Document 1: JP 2000-120141 A
Patent Document 2: JP 2004-275985 A
Patent Document 3: JP S58-49300 B

SUMMARY OF THE INVENTION

Problems the Invention Seeks to Resolve

However, when the spout apparatus set forth in Patent Document 3 is used over a long period in a region where there is high calcium content in the municipal water, the calcium component hardens on interior wall surfaces of Karman vortex generating passages, and the resulting scale adheres thereto. In a spout apparatus of this type, a desired vortex is produced by designing the gap between the flow path obstacle and the surrounding inner wall surface at a specified dimension. Hence when scale adheres to the obstacle or to inner wall surfaces surrounding same, the dimension of this gap narrows (ceases to be the specified dimension), producing the risk that the desired vortex will not be generated. When a desired vortex can no longer be generated, the water spouting oscillation amplitude and oscillation frequency, etc. change, and the risk arises that the desired spouting will not be achieved.

This scale is difficult to remove by the force of water flow alone, but it is possible to remove by physical scraping, or by deforming the wall surface itself to which the scale is adhered. However, the obstacle and the inner walls surrounding same are disposed further upstream than the spout port, and are in a location unreachable by a user's hand, making maintenance difficult.

The present invention was undertaken in light of such problems, and has the object of providing a spout apparatus whereby, in a fluid device utilizing Karman vortices, a user can easily perform maintenance even when scale has adhered to the portions where a Karman vortex occurs.

Means for Resolving the Problem

To resolve the problems above, the spout apparatus of the present invention has a spout apparatus body and an oscillating element for discharging hot or cold water while causing it to reciprocally oscillate. In addition, the oscillating element above has: a supply passage into which hot or cold water supplied from the spout apparatus body flows; a vortex generating passage, disposed on the downstream side of this supply passage and having a hot or cold water colliding portion placed so as to close off a portion of the flow path cross section, for generating vortices in alternating opposing directions on the downstream side thereof by the collision of a portion of the hot or cold water guided from the supply passage with this hot or cold water colliding portion; and a spout port passage, disposed on the downstream side of the vortex generating passage, for spouting hot or cold water containing vortex streets guided from the vortex street passage, while causing same to reciprocally oscillate. In addition, the spout port passage is formed by a soft member capable of elastic deformation, and is attached to the spout apparatus body so that a user can manipulate the spout port passage to deform it. Moreover, the vortex generating passage is formed of an elastically deformable soft member, and is formed integrally with the spout port passage so that deformations of the spout port passage are transferred to the vortex generating passage.

In the invention thus constituted, hot or cold water discharged from a spout apparatus can be reciprocally oscillated using an oscillating element, therefore hot or cold water can be discharged over a wide range from a single spout port using a compact and simple structure. Also, the spouting direction can be changed without moving the discharge nozzle, therefore no problems such as wear of the movable portions occur, and a low cost, high durability spout apparatus can be provided. A user can easily remove scale adhering to the inner wall surface of the spout passage by manipulating the spout passage to deform it. Furthermore, when deformation of the spout port passage reaches the vortex generating passage, scale adhered to the vortex generating passage (including obstacles and surrounding inner wall surfaces which exert a large effect on oscillating spouting), which users have difficulty reaching, can be removed. By manipulating the spout passage to deform it so that the spout port passage and the vortex generating passage deform, scale adhering to the inner wall surface of the spout passage can be easily removed by a user. Thus by using the present invention a user can easily perform maintenance even when scale adheres to a Karman vortex generating passage.

In the spout apparatus of the present invention it is preferable for the oscillating elements, together with the vortex generating passage, to be integrally formed by a soft member capable of elastic deformation, with a seal for waterproof sealing to the spout port passage main unit, and for a deformation limiting portion to be formed between the seal portion and the vortex generating passage to prevent deformations of the seal portion from being transmitted to the spout port passage or the vortex generating passage.

In the invention thus constituted, by integrally forming the seal portion with the vortex generating passage, the requirement for a separate seal member (e.g., packing, etc.) between the spout apparatus and the vortex generating passage is eliminated, and the structure can be simplified. Also, by providing a deformation limiting portion between the seal portion and the vortex generating passage, deformations of the seal portion can be prevented from reaching the spout port passage or the vortex generating passage, even if the seal portion is crushed in order to seal the oscillating element to the spout apparatus body in a waterproof manner. Thus even when the seal portion is integrally formed with the vortex generating passage, a desired vortex can be produced, and a desired oscillating spouting achieved.

In the spout apparatus of the present invention, it is preferable to place the deformation limiting portion upstream of the vortex generating passage.

In the invention thus constituted, because there is no deformation limiting portion between the spout port passage and the vortex generating passage, deformation of the spout port passage can efficiently reach the vortex generating passage.

Also, in a spout apparatus of the present invention, it is preferable for multiple oscillating elements to be integrally formed by a soft member, and for affixing portions to be provided to affix each of the oscillating elements to the spout apparatus.

In the invention thus constituted, because multiple oscillating elements are integrally formed by a soft member, productivity can be improved. The provision of affixing portions for each of the multiple oscillating elements enables the affixing portions, which serve as support points for deformation, to be disposed at the optimal positions for the degree of vortex generating passage deformation to be maximized when the spout port passage is manipulated to deform it.

Effect of the Invention

The present invention provides a spout apparatus, whereby in a fluid device utilizing a Karman vortex, the apparatus can be easily maintained by a user even when scale adheres to a Karman vortex generating passage.

EMBODIMENTS OF THE INVENTION

Figure 1:
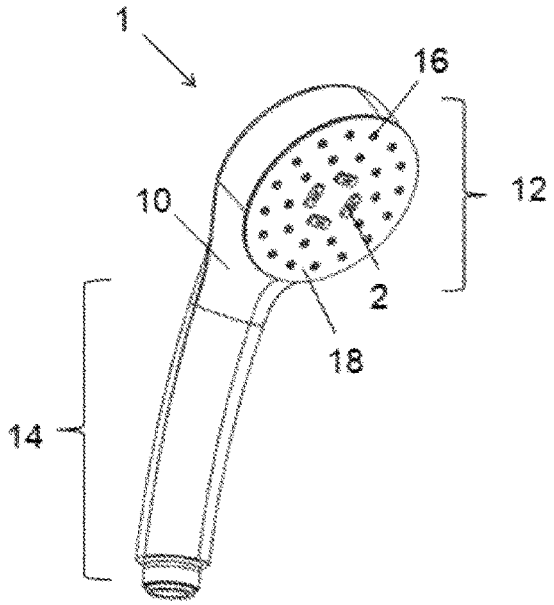
FIG. 1: An exterior view of a spout apparatus 1 in the present invention.

Below, referring to figures, we explain the spout apparatus 1 in an embodiment of the present invention. FIG. 1 is an external view of the spout apparatus 1 of the present invention. The spout apparatus 1 is what is known as a hand shower, and is made up of a spout apparatus body 10 and oscillating elements 2 disposed on the spout apparatus body 10. The spout apparatus body 10 broadly comprises a spout head 12 and a holding portion 14. Two types of spout ports consisting of multiple spout nozzles 16 and oscillating elements 2 are disposed on the spout head 10; spouting can occur simultaneously in each of these, or spouting can be achieved by switching successively between them.

Figure 2:
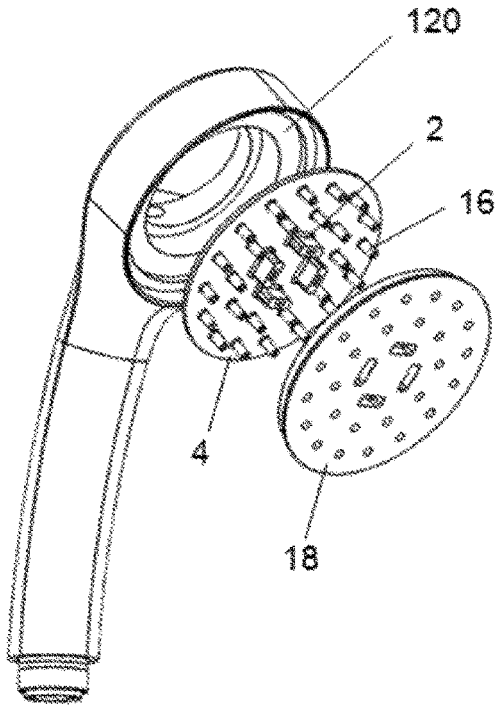
FIG. 2: An exploded perspective view of the spout apparatus 1 in the present invention.

FIG. 2 is an exploded perspective view of the spout apparatus 1 in the present invention. The spout head 12 is composed of a sprinkler packing 4 comprising a soft member having a sprinkler plate 18 disposed on its surface, oscillating elements 2, and spout nozzles 16. Multiple opening portions are disposed on the sprinkler plate 18; from these opening portions, the oscillating element 2 and spout nozzles 16 are assembled in a form projecting on the surface.

Figure 3:
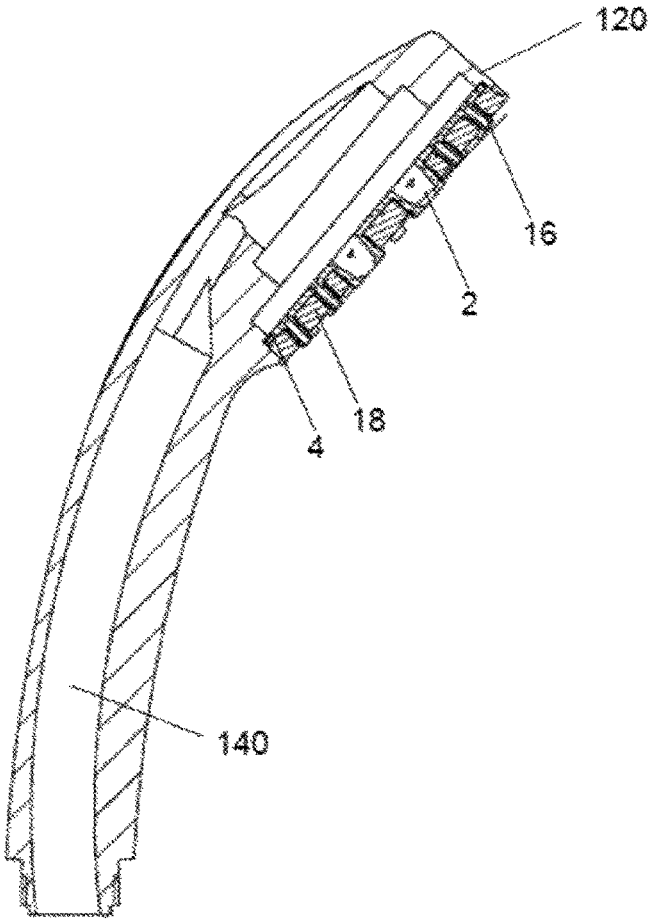
FIG. 3: A cross section of the spout apparatus 1 in the present invention.

FIG. 3 is a cross section of the spout apparatus 1 in the present invention. As shown in FIG. 3, the sprinkler packing 4 is affixed so as to be sandwiched between a spout head main unit 120 and the sprinkler plate 18. A water supply path 140 is formed inside the holding portion 14, and hot or cold water supplied from a shower hose, not shown, is supplied to the spout head 12.

Figure 4:
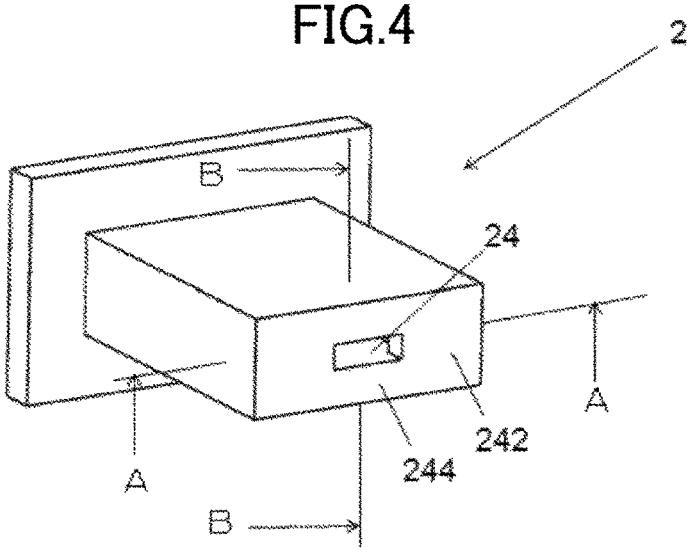
FIG. 4: An exterior view of an oscillating element 2 in the present invention.

FIG. 4 is an external view of the oscillating element 2 in the present invention. The oscillating element 2 has an approximately rectangular spout port, and is a nozzle for spouting water while reciprocally oscillating in the longitudinal direction of that rectangle. There are respectively a pair of first wall surface portions 242 on the long sides matching the direction in which hot or cold water reciprocally oscillates, and a pair of second wall surface portions 244 on the short sides perpendicular thereto, and the first wall surface portions 242 are thicker than the second wall surface portions 244.

Figure 5A:
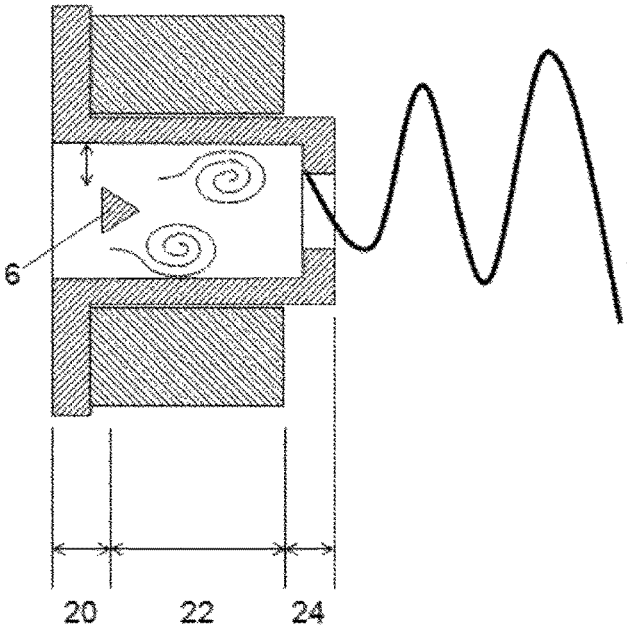
FIG. 5A: A schematic view of the oscillation of spout water in the present invention.
Figure 5B:
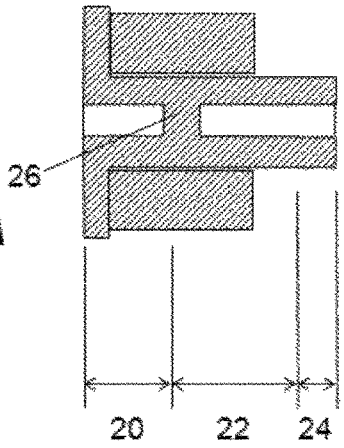
FIG. 5B: A schematic view of the oscillation of spout water in the present invention.

FIGS. 5A and 5B are a schematic diagrams showing the appearance of an operating oscillating element 2 in the main unit. FIG. 5A is a cross section through A-A in FIG. 4, but as shown here, a passage with a rectangular cross section is formed inside the oscillating element 2 so as to penetrate in the long direction. This passage is formed as a water supply passage 20, a vortex generating path 22, and a spout port passage 26 in that sequence from the upstream side of this path. The water supply passage 20 is a straight passage with a constant rectangular cross section extending from the inflow port on the rear side of the oscillating elements 2.

The vortex generating path 22 is a passage with a rectangular cross section disposed so as to connect with the water supply passage 20 (without level differences) at the downstream side of the water supply passage 20. I.e., it has the same dimensions and shape from the water supply passage 20 to the vortex generating path 22. The spout port passage 24 is a rectangular cross section passage disposed to connect with the vortex generating path 22 still further downstream of the vortex generating path 22. The spout port passage 24 is comprised so that its length in the direction of the long side of the cross sectional rectangle is shorter than the vortex generating path 22, and its cross section is small.

A hot or cold water collision portion 26 is disposed between the water supply passage 20 and the vortex generating path 22. This hot or cold water collision portion 26, as shown in FIG. 5B (a cross section through B-B in FIG. 4), is a triangle-shaped part extending to join with the wall surfaces (the ceiling surface and floor surface) opposing one another in the height direction of the water supply passage 20, and is disposed as an island at the center in the width direction of the water supply passage 20. The cross section of the hot or cold water collision portion 26 is formed as an isosceles triangle, wherein the two equal length sides are disposed to face downstream. By disposing this hot or cold water collision portion 26, a Karman vortex is formed within the vortex generating path 22, and hot or cold water spouted from the hot or cold water collision portion 26 reciprocally oscillates.

Note that of the hot or cold water collision portion 26, the surface area of the surface on which hot or cold water flowing from the water supply passage 20 collides, i.e., the flow path cross sectional area in the part of the water supply passage 20 blocked off by the hot or cold water collision portion 26, is constituted to be larger than the flow path cross sectional area of the spout port passage 24.

Figure 6:
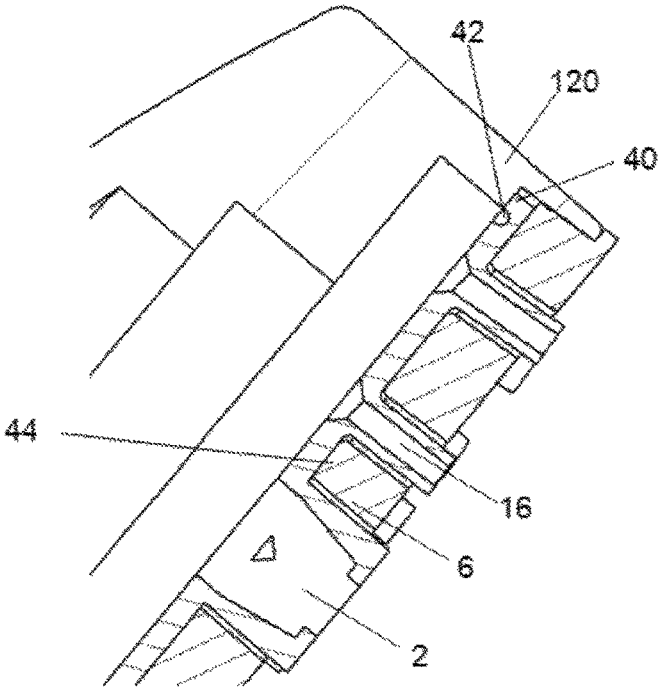
FIG. 6: An expanded cross section close to the seal portion 40 in the present invention.

FIG. 6 shows an expanded cross section of the spout head 12. As described earlier, the sprinkler packing 4 is affixed so as to be sandwiched between the spout head main unit 120 and the sprinkler plate 18. At this point, the sprinkler packing 4 also serves as a seal member for sealing between the spout head main unit 120 and the sprinkler plate 18, and has a seal portion 40 for making a watertight seal between the two. By being pressed by both elements, the seal portion 40 serves as a structure for assuring watertightness. Left alone, deformation caused by pressing causes the entire soft sprinkler packing 4 to spread out, such that the oscillating elements 2 and the spout nozzles 16 also distort, affecting spouting. To inhibit this, a deformation limiting portion 42 is disposed close to the seal portion 40. By this deformation limiting portion 42, distortion of the seal portion 40 is cut off further upstream than the oscillating element 2, so that distortion of the oscillating elements 2 or the spout nozzles 16 is suppressed, and aesthetic spouting is maintained.

A part of the sprinkler packing 4 is disposed with a tiny gap as a deformation limiting member 6 in the vicinity of the oscillating elements 2. As described below, this deformation limiting member 6 is provided to suppress expansion of the oscillating elements 2 caused by water pressure. Note that damage to the oscillating elements 2 through contact with the deformation limiting member 6 when the spout apparatus 1 is assembled can be suppressed by forming a tiny gap between the deformation limiting member 6 and the oscillating elements 2.

Next we explain the arrangement for removing scale in the present invention, referring to the FIGS. 7A-7D schematic.

Figure 7A:
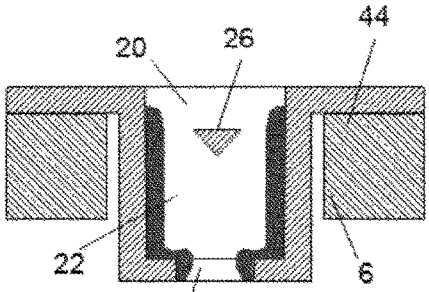
FIG. 7A: A schematic view of scale removal in the present invention.

Scale occurs when silica or calcium contained in municipal water is gradually deposited on the wall surface of a water conduit. In the spout apparatus 1, as shown in FIG. 7A, there is gradual deposit and accumulation on the spout nozzles 16, the water supply passage 20, the vortex generating path 22, the spout port passage 24, and so forth. When scale adheres and deposits at such locations, it affects the generation of Karman vortices and spouting, so there is a potential that spout water oscillation or spouting itself will distort.

Figure 7B:
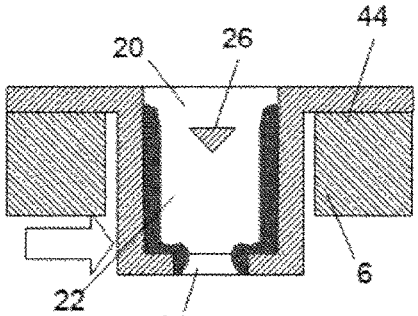
FIG. 7B: A schematic view of scale removal in the present invention.
Figure 7C:
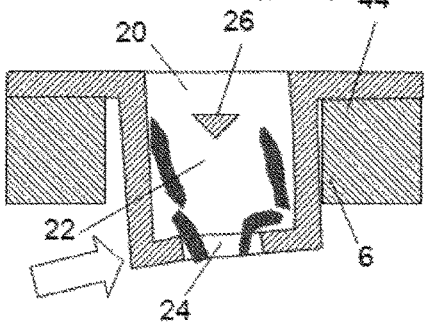
FIG. 7C: A schematic view of scale removal in the present invention.
Figure 7D:
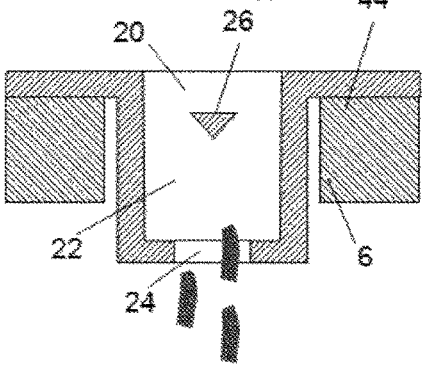
FIG. 7D: A schematic view of scale removal in the present invention.

At this point, pressure is applied by a finger or the like from the side surface of the spout port passage 24 projecting on the surface of the sprinkler plate 18, as shown in FIG. 7B. When this happens, as shown in FIG. 7C, deformation of the spout port passage 24 is transmitted to the water supply passage 20, and scale falls off due to the respective deformations. When water is spouted in this state, as shown in FIG. 7D, the fallen scale is flushed out and removed from the oscillating element 2.

Figure 8:
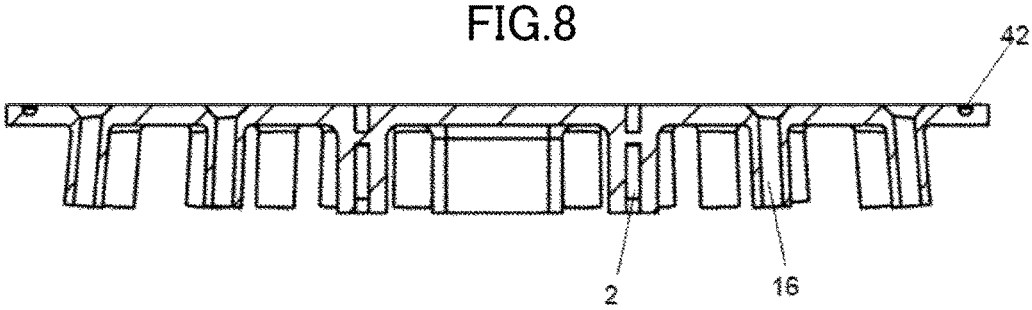
FIG. 8: A cross section of the shower nozzle 16 in the present invention.

As shown in FIG. 8, the oscillating element 2 comprises a soft member as the sprinkler packing 4 in an integrated piece with the spout nozzles 16, the seal portion 40, etc. Thus multiple functions such as sealing between the sprinkler plate 18 and the spout head main unit 120 can be given to a single member without transferring the deformation of the oscillating element 2 spout port passage 24 to the vortex generating path 22, and without providing separate seal members.

Figure 9:
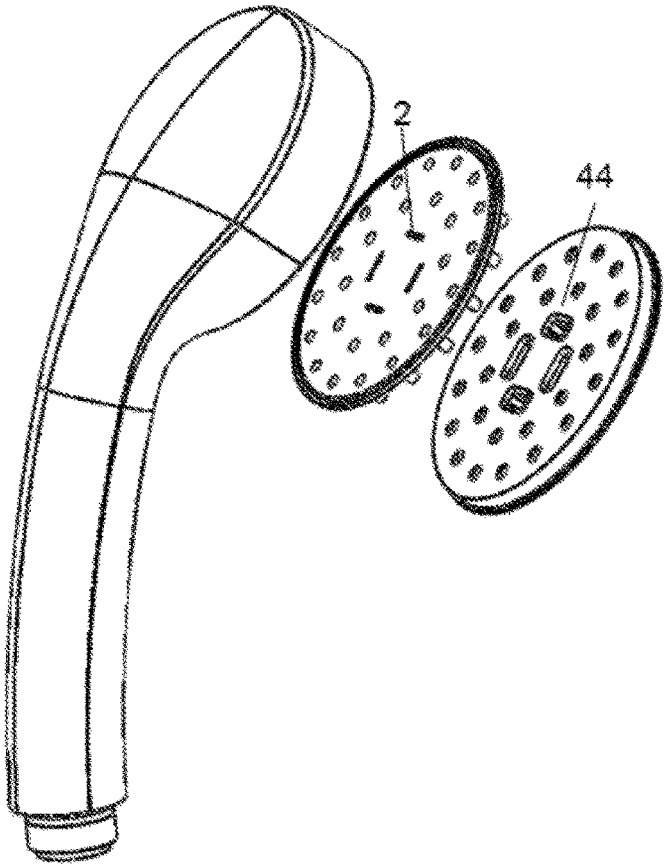
FIG. 9: An exploded perspective view seen from the rear side of the spout apparatus 1 in the present invention.

As shown in FIG. 9, multiple oscillating elements 2 are disposed on the sprinkler packing 4. At this point, the sprinkler packing 4 and the reverse surface of the sprinkler plate 18 make contact around the respective oscillating elements 2 and act as an affixing portion. Thus when force is applied such that an oscillating element 2 spout port passage 24 deforms, the locations reached by the deformation are limited to the area surrounding each of the oscillating elements 2. Stated different, the force applied to the spout port passage 24 can be utilized to distort each of the oscillating elements 2 so that scale can be efficiently removed. If affixing portions are not provided in this way, force is absorbed by the deformation of the entire sprinkler packing 4, and there is a possibility that the vortex generating path 22 will not deform well, and scale will not be fully removed.

Figure 10A:
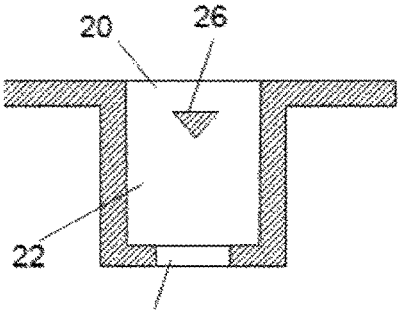
FIG. 10A: A schematic of the appearance when water pressure is applied to the oscillating element 2 in a comparative example.
Figure 10C:
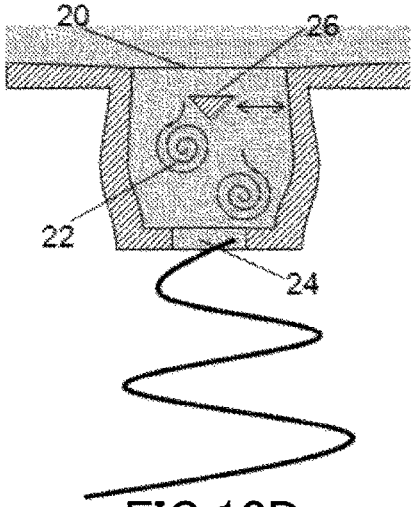
FIG. 10C: A schematic of the appearance when water pressure is applied to the oscillating element 2 in a comparative example.
Figure 10B:
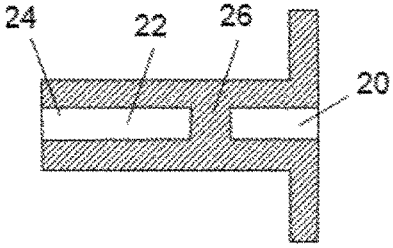
FIG. 10B: A schematic of the appearance when water pressure is applied to the oscillating element 2 in a comparative example.
Figure 10D:
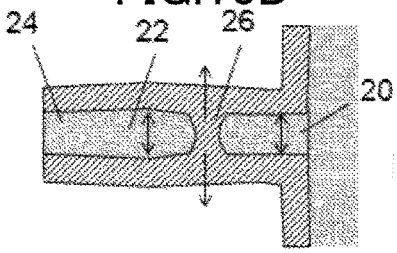
FIG. 10D: A schematic of the appearance when water pressure is applied to the oscillating element 2 in a comparative example.

FIGS. 10A-10D schematically shows the appearance when water pressure is applied to the oscillating elements 2 in a comparative example. In this comparative example there is no deformation limiting member 6 provided, in contrast to the invention embodiment. When no water pressure is applied, no deformation occurs, as shown in FIGS. 10A and 10B. When a certain water pressure or greater is applied, however, then as shown in FIGS. 10C and 10D, the oscillating elements 2 composed of a soft material distort greatly to the outside due to the water pressure on the vortex generating path 22 and the like. Because oscillation of spout water in the oscillating elements 2 varies depending on the size of the Karman vortex generated in the vortex generating path 22, large changes of this part lead to a risk that spouting may not occur as planned. Also, since there is also spreading in the height direction, as shown in FIG. 10D, there is a risk that the hot or cold water collision portion 26 will be greatly pulled in the long direction, ultimately breaking.

Figure 11A:
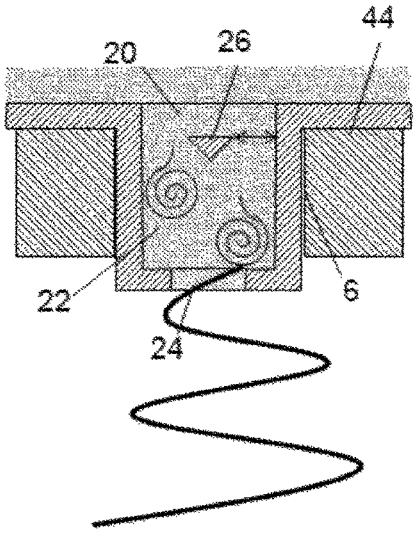
FIG. 11A: A schematic of the appearance when water pressure is applied to the oscillating element 2 in an embodiment of the present invention.
Figure 11B:
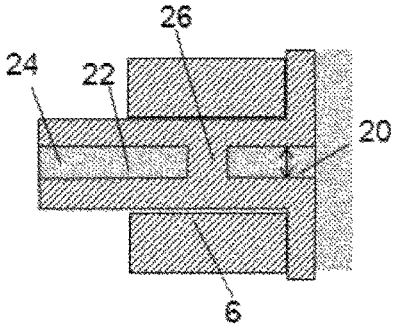
FIG. 11B: A schematic of the appearance when water pressure is applied to the oscillating element 2 in an embodiment of the present invention.

In comparison, FIGS. 11A and 11B schematically show the appearance when water pressure is applied to the oscillating elements 2 in an embodiment of the invention. In the embodiment, a deformation limiting member 6 is disposed close to the oscillating elements 2. By this means, expansion of the oscillating elements 2 can be suppressed by the deformation limiting member 6 even when water pressure is applied to the oscillating elements 2 composed of a soft material. In other words, specified dimensions for the oscillating elements 2 can be maintained even when significant water pressure is acting thereon.

Figure 12A:
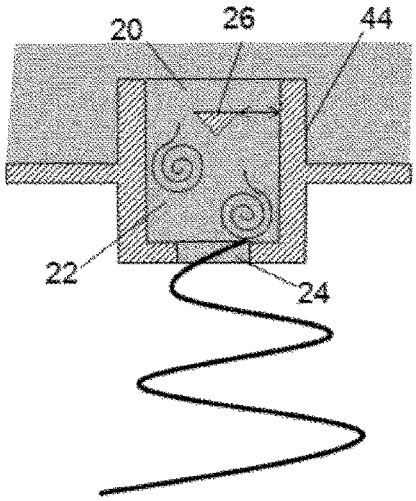
FIG. 12A: A schematic of the appearance when water pressure is applied to the oscillating element 2 in a variant example of the present invention.
Figure 12B:
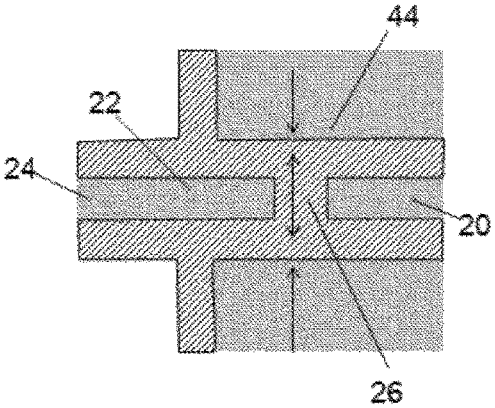
FIG. 12B: A schematic of the appearance when water pressure is applied to the oscillating element 2 in a variant example of the present invention.
Figure 13:
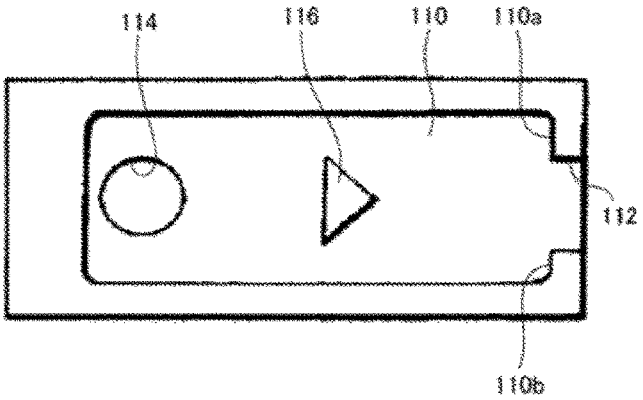
FIG. 13: A diagram showing the constitution of the fluid device set forth in Patent Document 3.

FIGS. 12A and 12B shows a oscillating elements 2 in a variant example of the invention. In this variant example, because expansion of the oscillating elements 2 under the action of water pressure is suppressed, a water pressure action portion 60 is provided in place of the deformation limiting member of the embodiment. By placing this water pressure action portion around the side surfaces of the vortex generating path 22, the water pressure acting in a direction which spreads the vortex generating path 22 from inside balances the water pressure acting to shrink the vortex generating path 22 from the outside, with the result that expansion of the oscillating elements 2 can be suppressed.

In the embodiment of the present invention, as in the variant example, the oscillating elements 2 are constituted by a soft material so as to suppress the expansion of the oscillating elements 2; scale can be removed and specified dimensions can be maintained even when a high water pressure acts upon the oscillating elements, so that spouting can be maintained and the durability of the oscillating elements 2 can be improved.

Note that in the spout port passage 24, as shown in FIG. 4, the long direction second wall surface portions 244 are thicker than the short direction first wall surface portions 242. By making thicker long direction first wall surface portions 242 on which oscillating kinetic energy acts in addition to water pressure, the durability of the first wall surface portions 242, which contribute to formation of the oscillation, can be improved, and the occurrence of cracks and the like can be suppressed. Also, deformation of the first wall surface portions 242 can be suppressed and oscillating spouting at a desired amplitude can be accomplished, even when a high water pressure is imparted to the spout port passage 24.

On the other hand the second wall surface portions 244 may have a thin constitution; i.e., they may be formed to deform easily. Thus deformation can be accomplished by deforming with a light force even when removing scale by deforming with a finger or the like.

The above completes an explanation of the present invention with reference to an embodiment. The present invention is not limited to the embodiment above, and may be designed as appropriate within the scope of the invention. For example, an oscillating element alone may be used as the type of water spouting, or three or four types may be combined and used. Also, the vortex generating passage may be formed by a hard material and integrally formed with the spout port passage.

DESCRIPTION OF REFERENCE NUMERALS spout apparatus: 1
spout apparatus body: 10
spout head: 12
spout head main unit: 120
holding portion: 14
water supply path: 140
spout nozzle: 16
sprinkler plate: 18
oscillating elements: 2
water supply passage: 20
vortex generating path: 22
spout port passage: 24
first wall surface portions: 242
second wall surface portions: 244
hot or cold water collision portion: 26
sprinkler packing: 4
seal portion: 40
deformation limiting portion: 42
affixing portion: 44
deformation limiting member: 6
water pressure action portion: 60

The invention claimed is:

1. A spout apparatus for discharging hot or cold water with reciprocal motion, comprising:

a spout apparatus body;

a sprinkler plate disposed on a surface of the spout apparatus body; and an oscillating element, attached to the spout apparatus body, for discharging supplied hot or cold water with reciprocal motion;

wherein the oscillating element comprises:

a water supply passage into which hot or cold water supplied from the spout apparatus body flows;

a vortex generating passage, disposed downstream of the water supply passage, including a hot or cold water collision portion arrayed to block a portion of a flow path cross section, whereby the collision of a portion of hot or cold water guided from the water supply passage to the hot or cold water collision portion alternately produces oppositely circulating vortexes on the downstream thereof; and a spout port passage disposed on the downstream side of the vortex generating passage, for discharging hot or cold water guided from the vortex generating passage with reciprocal motion;

wherein the spout port passage is formed of an elastically deformable soft material, and is attached to the spout apparatus body so that a user can manipulate and deform the spout port passage;

wherein the vortex generating passage is formed of the elastically deformable soft material, and is integrally formed with the spout port passage so that deformation of the spout port passage is transmitted to the vortex generating passage;

wherein a leading end of the spout port passage is projected beyond a front surface of the sprinkler plate, whereas the hot or cold water collision portion is disposed inside of the front surface of the sprinkler plate; and wherein the downstream end of the water supply passage has a constant cross section.

2. The spout apparatus of claim 1, wherein the oscillating element further comprises a seal portion for watertightly attaching to the spout apparatus body, the seal portion is integrally formed together with the vortex generating passage with the elastically deformable soft material, and wherein a recess disposed on a surface of the sprinkler packing is formed between the seal portion and the vortex generating passage to prevent deformations of the seal portion from being transmitted to the spout port passage or the vortex generating passage.

3. The spout apparatus of claim 2, wherein the recess is disposed upstream of the vortex generating passage.

4. The spout apparatus of claim 1, wherein the oscillating element comprises a plurality of oscillating elements, and the oscillating elements are integrally formed as a single piece, and affixing portions for affixing to the spout apparatus body are disposed relative to each of the oscillating elements.

5. The spout apparatus of claim 1, wherein the downstream end of the water supply passage has a rectangular cross section.

* * * * *